US008534310B1

(12) United States Patent
Ziehm

(10) Patent No.: US 8,534,310 B1
(45) Date of Patent: Sep. 17, 2013

(54) HOT WATER CIRCULATION SYSTEM

(76) Inventor: Raymond G. Ziehm, Littleton, CO (US)

( * ) Notice: Subject to any disclaimer, the term of this patent is extended or adjusted under 35 U.S.C. 154(b) by 0 days.

(21) Appl. No.: 13/507,772

(22) Filed: Jul. 27, 2012

(51) Int. Cl.

| | |
|---|---|
| ***F16K 49/00*** | (2006.01) |
| ***F16K 15/00*** | (2006.01) |
| ***F16K 17/00*** | (2006.01) |
| ***F16K 21/04*** | (2006.01) |
| ***F16L 53/00*** | (2006.01) |

(52) U.S. Cl.
USPC ..... 137/337; 137/519; 137/532

(58) Field of Classification Search
USPC ..... 137/337, 563, 512, 514, 519, 532, 137/498, 613, 614, 614.11, 614.13
See application file for complete search history.

(56) References Cited

U.S. PATENT DOCUMENTS

| | | | | |
|---|---|---|---|---|
| 2,842,155 | A * | 7/1958 | Peters | 137/337 |
| 4,286,573 | A * | 9/1981 | Nickel | 122/14.31 |
| 4,911,196 | A | 3/1990 | Kemp | |
| 4,915,129 | A | 4/1990 | Takayama | |
| 4,921,017 | A | 5/1990 | Tada | |
| 4,944,327 | A | 7/1990 | Gyben | |
| 5,323,803 | A | 6/1994 | Blumenauer | |
| 5,331,996 | A * | 7/1994 | Ziehm | 137/14 |
| 5,518,022 | A * | 5/1996 | Ziehm | 137/15.01 |
| 5,622,203 | A * | 4/1997 | Givler et al. | 137/337 |
| 5,819,785 | A | 10/1998 | Bardini | |
| 6,779,552 | B1 | 8/2004 | Coffman | |

* cited by examiner

*Primary Examiner* — Stephen M Hepperle
*Assistant Examiner* — Michael R Reid
(74) *Attorney, Agent, or Firm* — William E. Hein

(57) ABSTRACT

A two-way check/bypass valve is connected between the hot and cold water supply lines at hot and cold water faucets located most distantly from the water heater in a building. The valve establishes and maintains convective hot water circulation at a low flow rate from the heater to the most distant hot water faucet, through the cold water supply line, and back to the heater, during the period of time when the hot and cold water faucets are closed. When the hot water faucet is opened, hot water is nearly instantly available. Convective hot water circulation is stopped by the valve when either the hot or cold faucet is opened. The valve also prevents mixing of hot and cold water when either the hot or cold faucet is open and includes provision for dampening any water hammer effect.

8 Claims, 5 Drawing Sheets

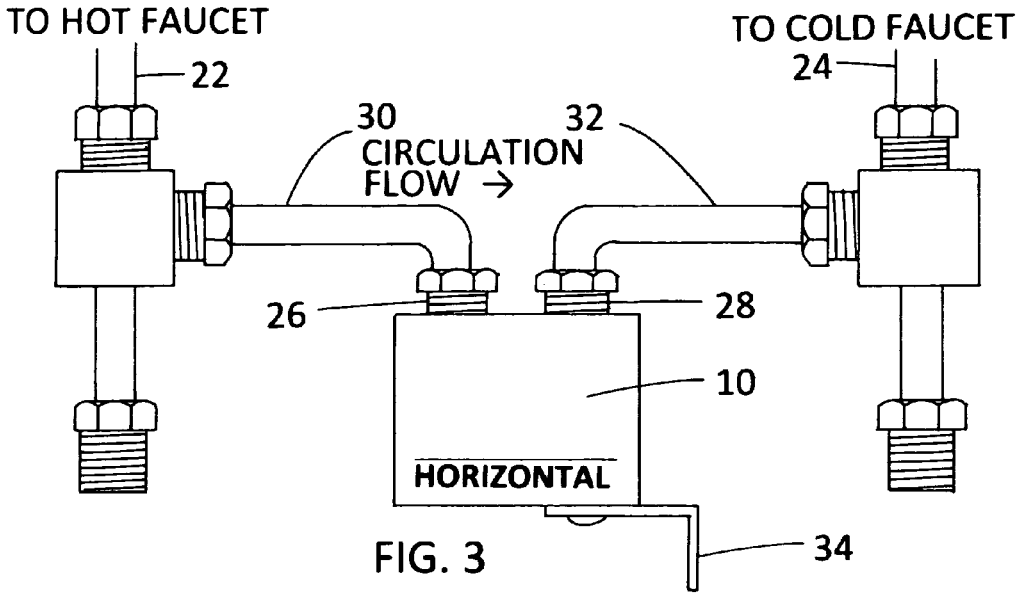
FIG. 3
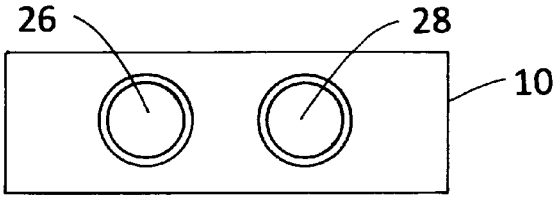
FIG. 4B
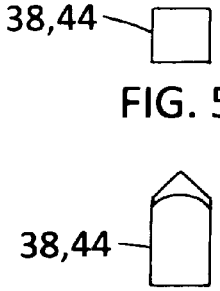
FIG. 5B
FIG. 5A
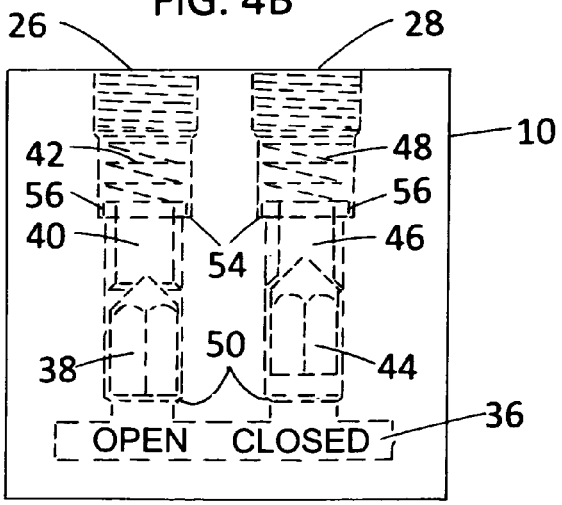
FIG. 4A
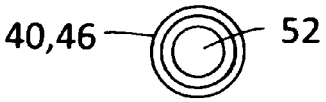
FIG. 6B
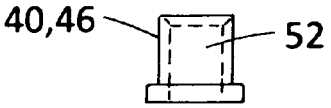
FIG. 6A

HOT WATER CIRCULATION SYSTEM

BACKGROUND AND SUMMARY OF THE INVENTION

This invention relates generally to hot water circulation systems that rapidly deliver hot water from a conventional water heater to a hot water faucet and, more particularly, to such a system employing a two-way check/bypass valve for increased efficiency and performance.

The need for and benefits of making hot water rapidly available at remote faucets in residential buildings is well known. However, minimal progress has been made over the years toward implementation of systems satisfying that need. It has been estimated that the average home in America wastes up to 10,000 gallons of potable water each year as homeowners run cool water down the drain while waiting for hot water to reach a faucet remote from the water heater. Since the wasted water was once hot, the heat energy it contained is also wasted.

The time required for hot water to reach a remote faucet depends on the length of the line from the water heater to the faucet. In many buildings, the delay amounts to a minute or more. At a typical faucet flow rate, five to six gallons of water can be wasted several times a day at a given faucet.

Tests have shown that water in an un-insulated ¾-inch diameter copper pipe at a temperature of 118° F. in an ambient environment of 70° F., will cool to 100° F. in about twenty minutes. If the supply line is ½-inch in diameter, the temperature will drop to about 95° F. Water at a temperature of 100° F. is warm to the touch, but cannot be considered hot. The reintroduction of heater-temperature water to the system is necessary to deliver hot water at a faucet. A simple solution to this waste of water and heat energy is to establish a circulation flow of hot water from the existing water heater through the normal hot water distribution line to the most remote hot water faucet on the plumbing branch, and back to the heater. This can be accomplished using a dedicated return line from the hot water faucet line typically located under the sink to the water heater, or by routing the return flow into the normal cold water supply line back to the water heater. Contrary to the belief of the average plumber, engineering tests and analyses have proven that circulation systems will conserve heat energy as compared to standard systems without circulation.

Water circulation can be accomplished either passively or actively. Passive circulation systems rely on convection forces resulting from differential temperatures between the hot and cold supply lines, whereas active systems incorporate an electric pump and possibly electronics connected to an electrical outlet to control the pump and a valve. Connections that must be made to the water piping are somewhat more complex in the case of active water circulation systems.

Passive water circulation systems operate on the principal of convective flow, by which hot water will rise and cool water will fall in a closed loop, without the need of a pump. Since hot water cools as it travels away from the heater and since cool water is denser than hot water, a higher pressure will exist in the cold line. This higher pressure will cause a low level circulation flow from the heater up to the high point in the loop at the remote hot water faucet, so long as a vertical separation of a few feet exists between the water heater and the faucet. This vertical separation exists in the normal home in which the water heater is in the basement and the faucets are on the main or a higher floor. This low level flow rate is sufficient to maintain hot water at remote faucets, and will operate continuously, day and night, without attention. Convective circulation systems require no electrical power, no gas, and no burner, and operate reliably with few moving parts, based upon the laws of physics.

Convective water circulation systems will cool by only 15-20° F. in the loop to and from the water heater at a flow rate of about 240 cubic centimeters per minute. This temperature loss represents a smaller heat energy loss than the combined heat energy loss resulting from allowing previously heated water to go down the sink drain while the user waits for hotter water to arrive and the energy required to heat the replacement water entering the water heater at about 50° F.

Active circulation systems employ a pump, control circuitry, and complex mechanisms that are expensive and require a source of electrical power and a professional installer. They are less reliable than passive circulation systems since they utilize more components. In active circulation systems, the pump will start at a preset water line temperature or elapsed time in order to restore hot water at the remote hot faucet. Typically, the time interval between pump cycles will be on the order of twenty minutes. At the end of each pump cycle, the water at the faucet will be hot and will then gradually cool before the pump starts again.

With an emphasis on simple installation, industry trends have moved toward the use of the cold water supply line as the return loop for circulation in both active and passive systems, thereby avoiding the costly and sometimes difficult installation of a dedicated return line. Circulation can be achieved through the addition of a crossover line between the hot and cold supply lines under the sink. The circulation path is from the water heater through the normal hot water supply line, through the crossover line, into the cold water supply line, and back to the water heater. The crossover line must also provide a means to prevent mixing of hot and cold water when a faucet is opened.

A review of prior art water circulation systems that utilize the cold water supply line as a return line reveals that most of them utilize a standard one-way check valve in order to prevent cold water from flowing into the hot side of the system when the hot faucet is opened. Some prior art systems utilize either a thermostatically-operated or solenoid-operated valve to prevent that situation. Other prior art systems, such as those described in U.S. Pat. No. 5,819,785 to Bardini, U.S. Pat. No. 5,323,803 to Bluemenauer, and U.S. Pat. No. 6,779,552 to Coffman, for example, address the above problem, but fail to recognize the need to prevent hot water from flowing into the cold side of the system when the cold faucet is opened. Solenoid valves operated on a timed basis may avoid the problem, but thermostatically-controlled valves may allow hot water to flow into the open cold water faucet during a portion of the valve's operating cycle as it responds to changes in water temperature. Moreover, these prior art systems fail to recognize, that unlike waiting for hot water to arrive at a remote hot water faucet in systems without circulation, cold water will never flow from the cold water faucets. Without some additional provision, hot water will flow through the bypass line into the cold water line, and lukewarm water will be delivered at the cold water faucet. Finally, each of these prior art valves contains free poppets with no provision to avoid a water hammer effect upon closing.

The system described in U.S. Pat. No. 2,842,155 to Peters describes a valve using a thermostatically-operated ball for controlling convective flow, primarily in the direction from hot to cold, and a free ball check to prevent cold to hot flow when the hot faucet and the thermostatically-controlled ball are open. No provision to avoid a water hammer effect is provided in this valve.

U.S. Pat. No. 4,391,295 to Stipe describes a one-way, gravity-operated cheek valve for use in a convective hot water circulation system. A slow-closing valve with gravity reseating provides damping of valve closures that are otherwise noisy and potentially damaging. The slow-closing valve is a one-way valve for use in systems employing a dedicated return line and is of no usein systems returning water through the cold water supply line.

The present invention provides a high-performance, inexpensive, maintenance-free passive hot water circulation system for use in both existing buildings and new construction that eliminates the need for an expensive dedicated hot water return line and that may be packaged in kit form for easy installation by a homeowner. It utilizes a two-way check/bypass valve that is connected between the hot and cold water supply lines at hot and cold water faucets that are located most distantly from the water heater in a plumbing branch of a building. The two-way check/bypass valve establishes and maintains convective hot water circulation at a low flow rate from the water heater to the most distantly located hot water faucet, through the cold water supply line of the plumbing branch, and back to the water heater, during the period of time when both the hot and cold water faucets are closed. When the hot water faucet is opened, hot water is nearly instantly available. The two-way check/bypass valve stops convective hot water circulation when either the hot or cold faucet is opened. It also prevents mixing of hot and cold water when either the hot or cold faucet is open and includes provision for dampening any water hammer effect.

BRIEF DESCRIPTION OF THE DRAWINGS

FIG. 3 is a pictorial diagram illustrating the details of connection of the under-sink components shown in FIG. 2.

FIG. 4A is a front elevation pictorial diagram illustrating the structural details of the two-way check/bypass valve of FIGS. 1 and 2.

FIG. 4B is a top view of the two-way check/bypass valve of FIGS. 1, 2, and 4A.

FIG. 5A is a front elevation view of one of the valve poppets employed in the two-way check/bypass valve of FIG. 4A.

FIG. 5B is a top plan view of the valve poppet of FIG. 5A.

FIG. 6A is a front elevation view of one of the movable valve seats employed in the two-way check/bypass valve of FIG. 4A.

FIG. 6B is a right side elevation view of the movable valve seat of FIG. 6A.

DETAILED DESCRIPTION OF THE PREFERRED EMBODIMENT

Figure 1:
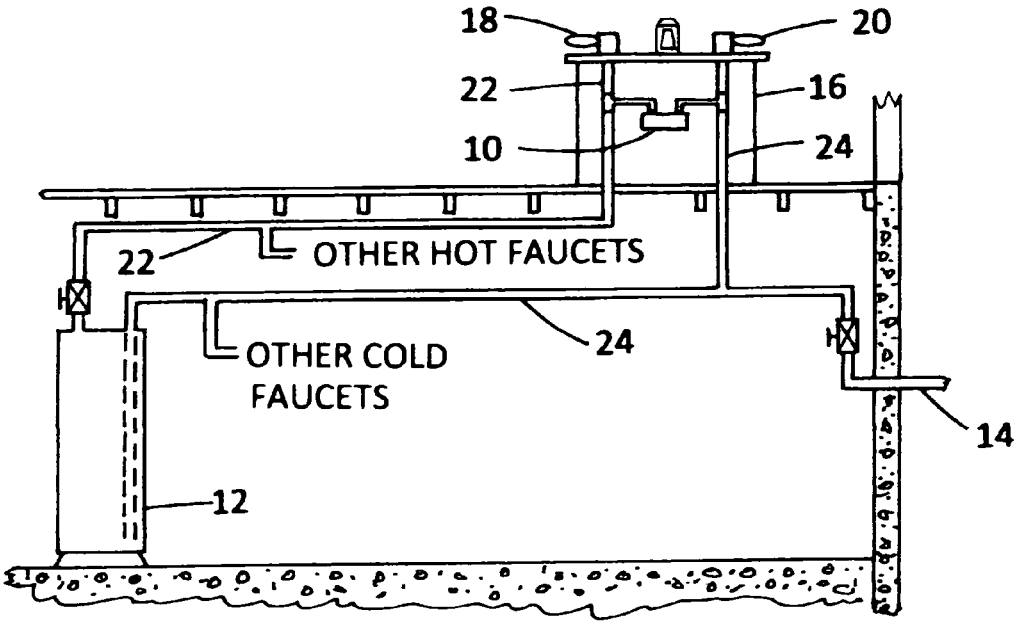
FIG. 1 is a pictorial diagram illustrating the components of the convective hot water circulation system of the present invention.
Figure 2:
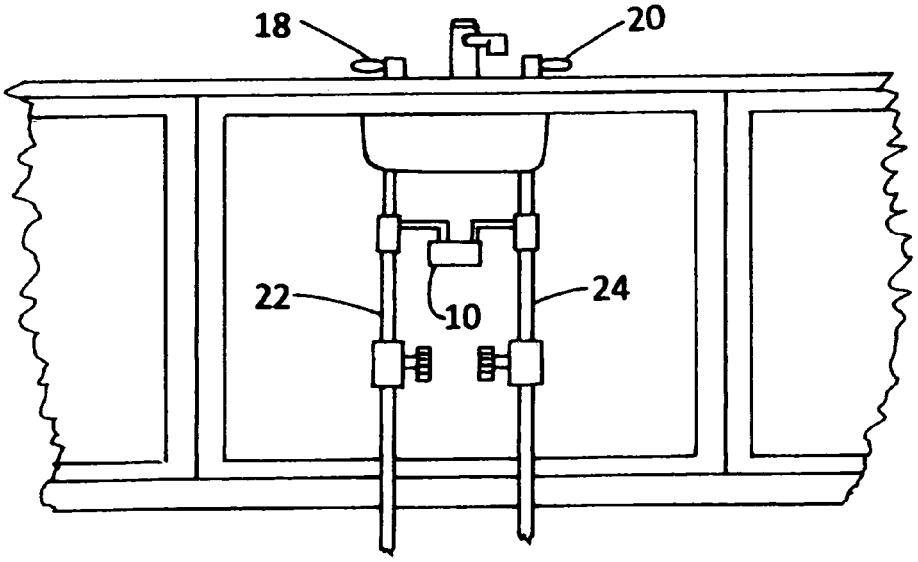
FIG. 2 is a pictorial diagram of the under-sink components of the convective hot water circulation system of FIG. 1.

Referring now to FIGS. 1 and 2, there is shown the two-way check/bypass valve 10 of the present invention connected to a typical residential water delivery system that includes a conventional water heater 12, usually positioned in a residential basement or crawl space area, for receiving cold water from a potable water source 14, such as a public utility. Hot water produced by water heater 12 is conventionally piped to various appliances throughout the residence, such as a lavatory 16, that allows the user to draw hot water from a hot water faucet 18. Cold water from source 14 is likewise piped to various cold water faucets throughout the residence, including cold water faucet 20 of lavatory 16.

Referring now to FIG. 3, there are shown the details of a typical connection of two-way check/bypass valve 10 to the existing hot and cold water supply lines 22, 24 within the enclosure of lavatory 16, which represents the most remotely located of all of the building plumbing fixtures or appliances to which hot water is supplied. A conventional flexible or formed metallic line 30 serves to connect an inlet port 26 of two-way check/bypass valve 10 to hot water supply line 22. An outlet port 28 of two-way check/bypass valve 10 is similarly connected by line 32 to cold water supply line 24. Two-way check/bypass valve 10 may be mounted within the enclosure of lavatory 16 by means of a suitable bracket 34 to ensure that two-way check/bypass valve 10 is positioned horizontally in two axes.

Referring now additionally to FIGS. 4A-B, 5A-B, and 6A-B, two-way check/bypass valve 10 includes a housing constructed of a selected metal or plastic material and is formed to include a convection circulation cavity 36 within a lower portion of the housing. Two vertical cylindrical bores within the housing of two-way check/bypass valve 10 open at their lower ends into convection circulation cavity 36, while their top ends terminate at inlet and outlet ports 26, 28. The bore associated with inlet port 26 contains a one-way valve, illustrated in its open position, that includes a poppet 38, a valve seat 40 positioned above poppet 38, and a spring member 42 positioned between valve seat 40 and inlet port 26. The bore associated with outlet port 28 also contains a one-way valve, illustrated in its closed position, that includes a correspondingly-positioned poppet 44, a valve seat 46, and a spring member 48. Poppets 38, 44 are shaped to be non-cylindrical in cross-section, such as rectangular, triangular, grooved, or some other shape having a cross-sectional area that is smaller than the cross-sectional area of the associated cylindrical bore to permit water to flow around poppets 38, 44 when the respective valve is open. When that valve is in the open position, the bottom surface of the associated one of poppets 38, 44 contacts a shoulder 50 provided near the bottom of the cylindrical bores. Each of the valve seats 40, 46 contains a central water passageway 52 to permit water to flow through it when an associated one of poppets 38, 44 is in the down or valve-open position. Valve seats 40, 46 are shaped to include a lower shoulder portion 56 that is urged downward against a shoulder 54 of each of the cylindrical bores by respective ones of spring members 42, 48. The upper ends of poppets 38, 44 are conically shaped to engage the central water passageway 52 in valve seats 40, 46 when one of the poppets 38, 44 is held in the up or valve-closed position by differential water pressure between inlet port 26 and outlet port 28 of two-way check/bypass valve 10 to thereby prevent the flow of water through the valve. In this embodiment, poppets 38, 44 are constructed of a material having a specific gravity greater than unity so that they will settle downward to the valve-open position when neither of the faucets connected to the ports 26, 28 of two-way check/bypass valve 10 is open. Thus, two-way check/bypass valve 10 will permit a low circulation flow rate of water through it, but will close off the high flow rate that would otherwise occur upon opening either hot water faucet 18 or cold water faucet 20 to which two-way check/bypass valve 10 is connected.

A common characteristic of check valves, especially free poppet valves like those described above, is that they will often cause a pressure spike known as water-hammer when closing in a pressurized water system. They will also occasionally spike sympathetically in response to the sudden closure of other valves in a system, such as a toilet, clothes washer, or dish washer. In addition to the attendant unpleasant sound, these pressure spikes can be damaging to other components of a water delivery system. This problem is solved by the present invention, in which the freedom of movement of valve seats 40, 46 against springs 42, 48, when poppets 38, 44 contact the valve seats 40, 46, serves to absorb the energy created when the flow of water is suddenly interrupted and thus dampen any water-hammer effect that may otherwise occur.

The two-way-check bypass valve 10 described above operates in three different modes in the process of providing continuous rapid hot water to faucets of a residence or other building. All modes are completely automatic in the system, with no action or maintenance required by the user. The first mode of operation is considered dominant since it is in effect most of the time. That is the time during which no water faucets in the plumbing system are open, and water is convectively circulating from water heater 12, through the hot water distribution line 22, to the two-way check/bypass valve 10, and eventually back to the water heater 12 through the existing cold water supply line 24. Convective flow rates of 200-400 cubic centimeters/second have been observed during testing. During this time, the circulating water will flow into the inlet or hot port 26 of two-way check/bypass valve 10, past poppet 38, through convection circulation cavity 36, past poppet 44, and out the outlet or cold port 28 to cold water supply line 24. This convective circulation is very reliable so long as adequate vertical separation between water heater 12 and remote hot water faucet 18 exists, no external heat is applied to cold water supply line 24, and no flow blockage is present in the system. Hot water is always available in the present system within seconds after opening a hot water faucet. It is recognized that the water in the cold water supply line 24 will tend to warm slightly during the convective circulation flow that is present during this first mode of operation.

The second mode of operation of two-way check/bypass valve 10 begins when a hot water faucet along hot water supply line 22 is opened. As hot water flows from the hot water faucet, the water pressure in hot water supply line 22 near two-way check/bypass valve 10 is lowered, and cold water will attempt to flow through cold water supply line 24 and through two-way check/bypass valve 10 to the outlet or hot port 26 of two-way check/bypass valve 10, thereby reducing the temperature of the outflow water. The dynamic pressure of the water flowing through two-way check/bypass valve 10 will cause poppet 38 to rise against valve seat 40 and stop the flow of water through valve seat 40. No water from cold water supply line 24 is allowed to enter hot water supply line 22. When the previously-opened hot water faucet is closed, gravity will cause poppet 38 to fall to its position against shoulder 50, as illustrated in FIG. 4A, thereby opening the associated valve and allowing convective circulation flow to resume in accordance with the first mode of operation described above.

The third mode of operation of two-way check/bypass valve 10 is the reverse of the above-described second mode of operation, in order to prevent hot water from flowing through two-way check/bypass valve 10 into cold water supply line 24 when a cold faucet is opened. As hot water attempts to flow through two-way check/bypass valve 10 to the cold side thereof, poppet 44 will rise to contact valve seat 46 and thereby stop the flow through valve seat 46.

A fourth mode of operation of two-way check/bypass valve 10 may be identified as relating to the availability of cold water at the temperature of water source 14 at a cold water faucet that prior art water circulation systems utilizing a one-way check valve system cannot support. This is accomplished by opening the cold faucet and allowing the warm water to flow down the drain until the warm water is replaced by water from the cold water source 14 through cold water supply line 24, similar to the process of obtaining hot water in a system that does not employ circulation. This fourth mode of operation is made possible by employing two-way check/bypass valve 10 that will not allow hot water into the cold line at the high flow rate, but is impossible when using a prior art one-way check valve.

Figure 7:
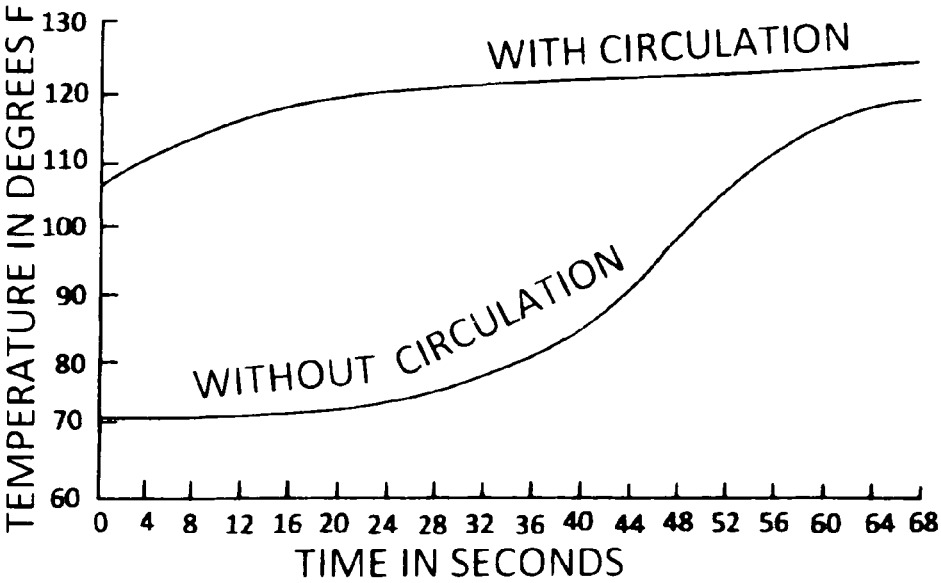
FIG. 7 is a graph of water temperature versus time illustrating the time required for heated water to reach a remote hot water faucet with and without the convective hot water circulation system of FIGS. 1 and 2.

In the first mode of operation of two-way check/bypass valve 10 described above, hot water at faucet 18 will reach a temperature in the range of 105-115° F., with a water heater setting of 120° F., within one to three seconds. Hot water faucets located closer to water heater 12 will produce hotter water than may be obtained at remotely located hot water faucet 18. The provision of insulation on hot water distribution line 22 between water heater 12 and remote hot water faucet 18 will result in hotter water at hot water faucet 18. The water temperature will rise to near the temperature of water at the outlet of water heater 12 within a short time after opening hot water faucet 18. FIG. 7 graphically illustrates the typical residential hot water temperature variation after opening a hot water faucet in a water distribution system employing convective circulation, as in the present invention, as compared to the same system without circulation. The difference between the two graphs that are illustrated reflects the loss of water, the loss of heat energy, and the waste of the user's time while waiting for hot water to arrive from the water heater.

Figure 8:
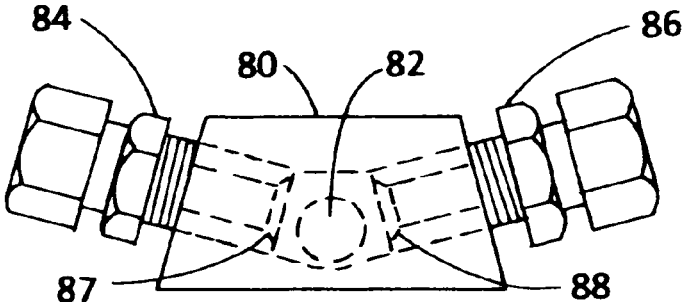
FIG. 8 is a pictorial diagram illustrating a rolling ball alternative embodiment of the two-way check/bypass valve of FIGS. 1 and 2.

Referring now to FIG. 8, there is shown an alternative embodiment 80 of the two-way check/bypass valve 10 described above. Alternative two-way check/bypass valve 80 employs a single spherical rolling ball 82 retained in an upwardly-curved passageway of circular cross section. Fittings 84, 86 are provided at each end of the upwardly curved passageway for connection to the hot and cold supply lines at remote faucets of a building water distribution system. Water attempting to flow from the hot supply line to the cold supply line or vice versa at a rate higher than required to support a convective flow of water in the system will be stopped as the rolling ball 82 is driven up the curved passageway to one of two circular valve seats 87, 88. This will occur when one or the other of the hot and cold faucets is opened, and the static pressure in the associated supply line is reduced. When that faucet is then closed, rolling ball 82 will roll, by gravity, to the lowest or neutral position along the curved passageway, at which position a larger cross-sectional area of the curved passageway will allow water to continue to flow through two-way check/bypass valve 80 at the low convective flow rate.

Figure 9:
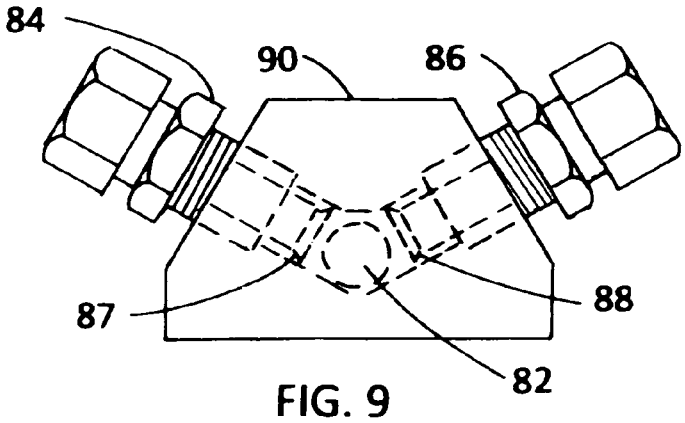
FIG. 9 is a pictorial diagram illustrating a variation in shape of the rolling ball embodiment of the two-way check/bypass valve of FIG. 8.

Referring now to FIG. 9, there is shown an alternative embodiment 90 of two-way check/bypass valve 80 of FIG. 8 wherein the circular passageway in which rolling ball 82 is positioned is formed to be V-shaped, extending upward and outward from valve seats 87, 88 and terminating at fittings 84, 86. Operation of two-way check/bypass valve 90 is the same as described above in connection with two-way check/bypass valve 80 of FIG. 8.

Figure 10A:
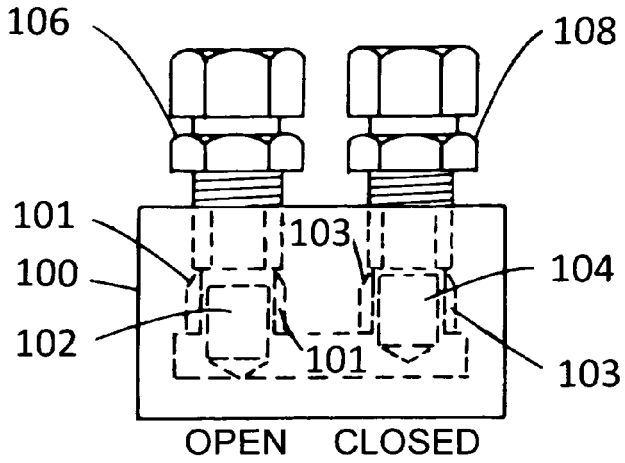
FIG. 10A is a front elevation pictorial diagram illustrating the structural details of a gravity-operated alternative embodiment of the two-way check/bypass valve of FIGS. 1 and 2.
Figure 10B:
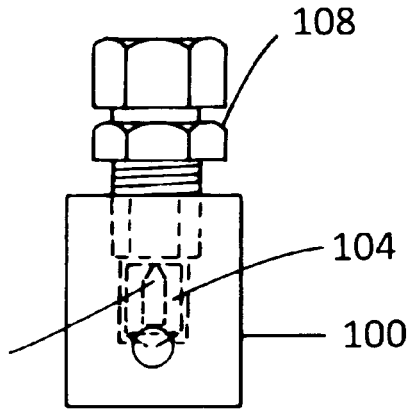
FIG. 10B is a right-side elevation view of the two-way check/bypass valve of FIG. 10A.

Referring now to FIGS. 10A-B, there are shown front and right side elevation views of an alternative embodiment 100 of two-way check/bypass valve 10 described above in connection with FIGS. 4A-B, 5A-B, and 6A-B. In the embodiment of FIGS. 10A-B, the convective flow of water moves past poppets 102, 104 in adjacent water bypass channels 101, 103 that terminate above poppets 102, 104 when in the down or valve-open position. As either one of the poppets 102, 104 is forced upward to the valve-closed position by dynamic water pressure when a faucet is opened, it covers a bottom surface of an associated one of inlet and outlet ports 106, 108, thereby stopping the flow of water through two-way check/bypass valve 100. Each of the water bypass channels 101, 103 is inwardly tapered at its upper end to effect a slower closing action in order to minimize any water hammer effect. Each of the poppets 102, 104 is returned to its down or valve-open position by gravity to thereby permit the convective flow of water through two-way check/bypass valve 100.

Figure 11:
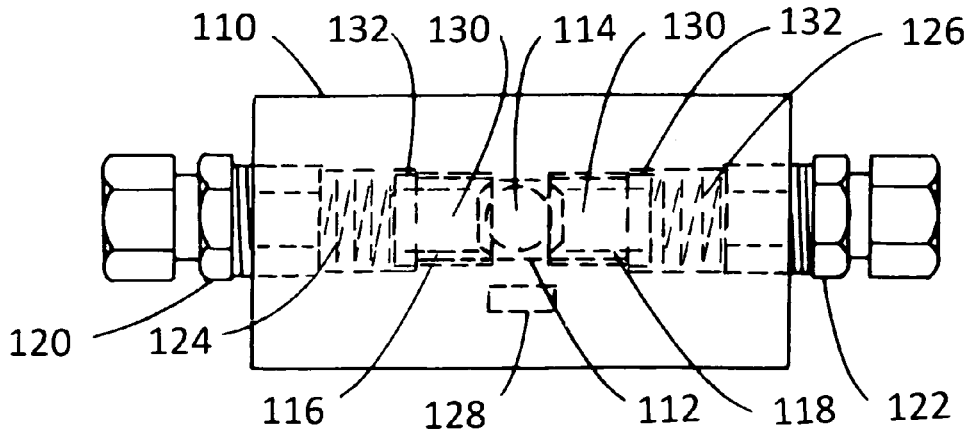
FIG. 11 is a front elevation pictorial diagram illustrating the structural details of a magnetically-operated alternative embodiment of the two-way check/bypass valve of FIGS. 1 and 2.

Referring now to FIG. 11, there is shown yet another alternative embodiment 110 of two-way check/bypass valve 10 described above in connection with FIGS. 4A-B, 5A-B, and 6A-B in which a single horizontal poppet bore 112 replaces the two vertical poppet bores illustrated in FIG. 4A. The housing of two-way check/bypass valve 110 is constructed of a non-magnetic material. Poppet bore 112 terminates at its distal ends in inlet and outlet ports 120, 122. A spherical ball poppet 114, constructed of a water-compatible magnetic material, is centrally positioned within poppet bore 112, midway between the distal ends of poppet bore 112. Moveable valve seats 116, 118, like valve seats 40, 46 illustrated in FIG. 4A, are positioned within poppet bore 112 on opposite sides of ball poppet 114. Like valve seats 40, 46, each of the valve seats 116, 118 contains a central water passageway 130 to permit water to flow through it. A spring member 124, like spring member 42 illustrated in FIG. 4A, is positioned between valve seat 116 and inlet port 120. Similarly, a spring member 126 is positioned between valve seat 118 and outlet port 122. Like shoulder portion 56 of valve seats 40, 46, each of the valve seats 116, 118 is shaped to include a shoulder portion 132 at the distal ends thereof that is urged, by spring members 124, 126, against a corresponding shoulder formed along the inner cylindrical wall of poppet bore 112. A permanent magnet 128 is imbedded in the housing of two-way check/bypass valve 110 adjacent poppet bore 112 at a position midway between the distal ends of poppet bore 112. When all faucets are closed, permanent magnet 128 maintains ball poppet 114 at its central position, where the cross-sectional area of poppet bore 112 is greater than its cross-sectional area on either side of ball poppet 114 to permit water to convectively flow around ball poppet 114 and, thus, through two-way check/bypass valve 110. When a faucet is opened, the differential pressure created thereby causes ball poppet 114 to roll either left or right from its central position and to engage the central water passageway 130 of one of the valve seats 116, 118 to stop the flow of water through two-way check/bypass valve 110. When that faucet is closed, permanent magnet 128 returns ball poppet 114 to its central position that permits water to again flow convectively through two-way check/bypass valve 110.

Figure 12:
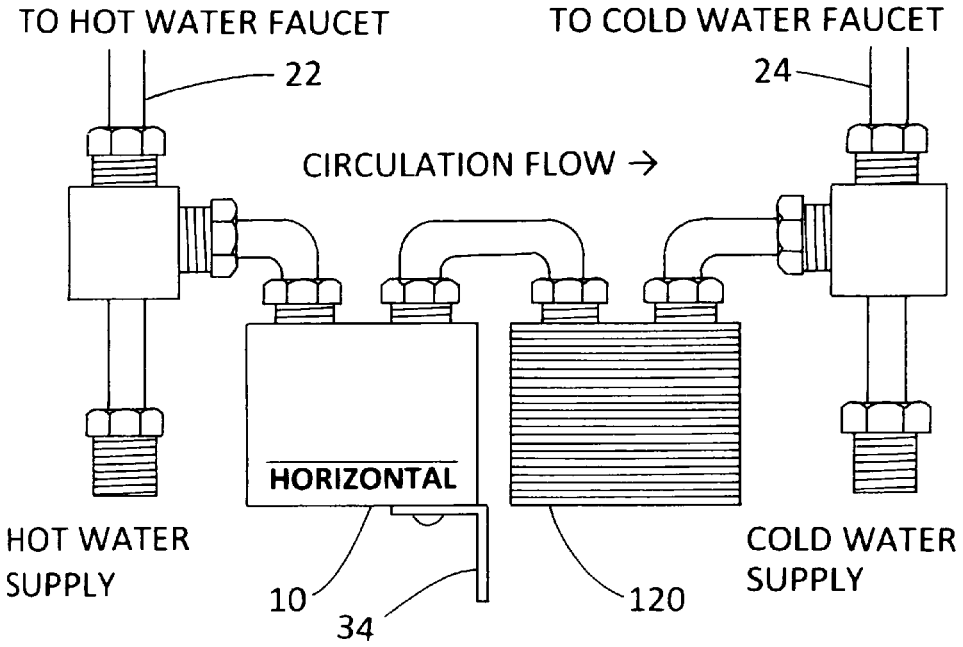
FIG. 12 is a pictorial diagram illustrating the details of connection of the under-sink components with a heat exchanger.

Referring now to FIG. 12, there is shown the two-way check/bypass valve 10 of FIGS. 1, 3, and 4A-B with the addition of a heat exchanger 120 connected between two-way check/bypass valve 10 and cold water supply line 24. Using the cold water supply line 24 as the return line to water heater 12, in accordance with the present invention, offers significant advantages over prior art systems that require running a costly separate return line to the water heater. In some buildings, installation of a separate return line is nearly impossible, even at significant cost. A minor drawback to using the cold supply line 24 as a return line is that some heating of the water in cold supply line 24 will result in a wait time of several seconds after remote cold faucet 20 is opened, if truly cold water is desired. However, this wait time is considerably shorter than the wait time required for hot water to reach a remote hot water faucet in prior art water distribution systems. The minor limitation just described should not be of concern since most remote hot water faucets in residences are located in bathrooms where instant cold water is rarely required. The use of a small (¾"×2½"×3") water-to-air heat exchanger 120 that is readily commercially available has been shown to reduce the temperature of water that would otherwise enter cold supply line 24 from two-way check/bypass valve 10 by three to five degrees F. during periods of normal convective circulation. A larger (¾"×5"×10") heat exchanger 120 resulted in reducing the temperature of water otherwise entering cold supply line 24 by five to nine degrees F. These seemingly small reductions in the temperature of water entering cold water supply line 24 will result in shorter wait times and less wasted water, when truly cold water is required at remote faucet 20. The heat exchanger 120 may be similarly connected to and employed with alternative two-way check/bypass valves 80, 90, 100, 100 of FIGS. 8, 9, 10A-B, and 11.

I claim:

1. A two-way check/bypass valve for connection to the hot and cold water supply lines of a building adjacent a plumbing fixture that is most remotely located from a water heater serving the building, said two-way check/bypass valve serving to convectively circulate water from the water heater, through the hot water supply line, and back to the water heater to thereby provide hot water, without delay, at the remotely-located plumbing fixture, comprising:

a housing having a convection circulation cavity within a lower portion thereof, said housing having two vertical cylindrical bores, lower ends of said vertical cylindrical bores communicating with said convection circulation cavity, an upper end of a first one of said two vertical cylindrical bores terminating at an inlet port of said two-way check/bypass valve, and an upper end of a second one of said two vertical cylindrical bores terminating at an outlet port of said two-way check/bypass valve, said lower ends of said vertical cylindrical bores having a circular lower shoulder, said inlet and outlet ports of said two-way check/bypass valve being connected to said hot and cold water supply lines, respectively;

a vertically-movable poppet positioned within each of said vertical cylindrical bores in said two-way check/bypass valve above a shoulder formed within each of said vertical cylindrical bores proximate a lower end thereof, each poppet having a cross-sectional area smaller than a cross-sectional area of each of said vertical cylindrical bores, and each poppet being constructed of a material having a specific gravity greater than unity;

a movable valve seat positioned within each of said vertical cylindrical bores in said two-way check/bypass valve above each of said poppets, each of said valve seats including a central water passageway, each of said valve seats formed to have a circular shoulder at an upper end;

a spring member positioned within each of said vertical cylindrical bores in said two-way check/bypass valve between said valve seat and respective ones of said inlet and outlet ports, said spring member serving to urge an associated valve seat downward such that its circular shoulder contacts an upper circular shoulder of an associated one of said vertical cylindrical bores, said spring member additionally serving to permit upward movement of an associated one of said valve seats to thereby dampen a water-hammer effect that may occur when the flow of water through said two-way check/bypass valve is suddenly interrupted;

each of said poppets having an upper end shaped to engage said central water passageway at a bottom end of one of said valve seats to prevent the flow of water through that valve seat when an associated one of said poppets is maintained in an upper, closed position by a differential water pressure between said inlet and outlet ports.

2. A two-way check/bypass valve as in claim 1, wherein a cross-sectional shape of each of said poppets is other than circular.

3. A two-way check/bypass valve as in claim 2, wherein each of said poppets is rectangular in cross section.

4. A two-way check/bypass valve as in claim 1, wherein said outlet port of said two-way check/bypass valve is connected to said cold water supply line through a heat exchanger.

5. A two-way check/bypass valve as in claim 1, wherein said upper end of each of said poppets is protrudingly shaped.

6. A two-way check/bypass valve as in claim 1, wherein said upper end of each of said poppets is conical in shape.

7. A two-way check/bypass valve as in claim 1, wherein said upper end of each of said poppets is hemispherical in shape.

8. A two-way check/bypass valve as in claim 2, wherein each of said poppets is triangular in cross section.

* * * * *